United States Patent [19]

Claver

[11] 4,283,898

[45] Aug. 18, 1981

[54] WALL PANEL CLAMPING APPARATUS

[75] Inventor: Jorge C. Claver, Barcelona, Spain

[73] Assignee: Cualitas Industrial, S.A., Barcelona, Spain

[21] Appl. No.: 22,892

[22] Filed: Mar. 22, 1979

[30] Foreign Application Priority Data

Mar. 22, 1978 [ES] Spain ..... 234874

[51] Int. Cl.[3] ..... E04C 1/10; E04C 1/30

[52] U.S. Cl. ..... 52/584; 52/309.9; 52/787

[58] Field of Search ..... 52/584, 787, 520, 127, 52/309.9, 309.11

[56] References Cited

U.S. PATENT DOCUMENTS

| | | | |
|---|---|---|---|
| 2,887,740 | 5/1959 | Potchen | 52/584 |
| 2,896,271 | 7/1959 | Kloote et al. | 52/309.9 X |
| 2,962,323 | 11/1960 | McBride | 52/309.11 X |
| 3,282,003 | 11/1966 | Swift, Jr. | 52/584 |
| 3,327,447 | 6/1967 | Nissley | 52/127 X |
| 3,854,261 | 12/1974 | Frei | 52/584 X |
| 4,045,927 | 9/1977 | Diaz | 52/584 X |
| 4,070,848 | 1/1978 | Lingle | 52/584 X |

FOREIGN PATENT DOCUMENTS

| | | | |
|---|---|---|---|
| 856841 | 12/1960 | United Kingdom | 52/584 |

*Primary Examiner*—Alfred C. Perham

*Attorney, Agent, or Firm*—Blum, Kaplan, Friedman, Silberman & Beran

[57] ABSTRACT

Wall panels having thermal insulation sandwiched between opposed metal skins, are joined together to provide a rigid joint which is flush and vacuum tight. Narrow heavy gauge elongated strip plates fit precisely within offsets in both skins adjacent to the joining surfaces, and are bolted to the skins. One strip plate includes internally threaded holes in which the fastening bolts are inserted and engaged from within the panel using a screwdriver or a wrench which passes from the opposite side through a clearance channel in the panel.

The other plate is held on the opposite panel side by bolts which engage threaded nuts attached to the adjacent offset skin portions. All bolt fasteners are accessible and attached from the same wall surface, with the bolts within the panels passing freely through the threaded nuts on the opposite skin. Accurate spacing of the holes in the strip plates and skin offsets assures a compressed butt joint between the insulation of the clamped panels.

In an alternative embodiment of this invention, the ends of the panels to-be-joined are provided with offsets which interlock and provide alignment of the adjacent panels before and after they are clamped together with bolts.

9 Claims, 8 Drawing Figures

FIG-1
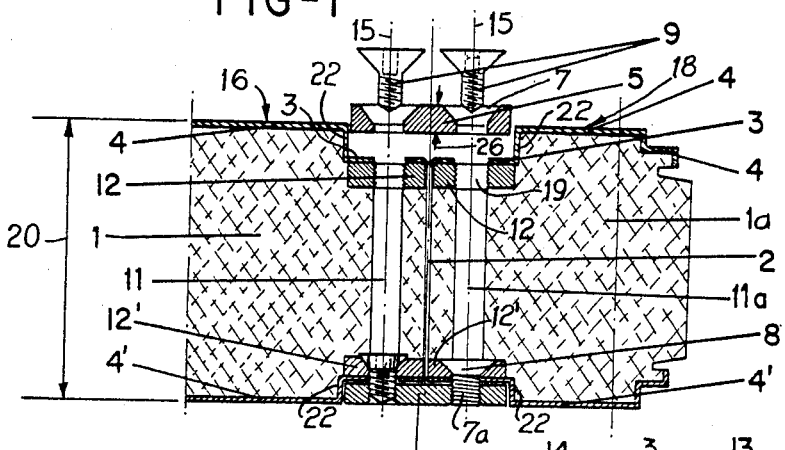
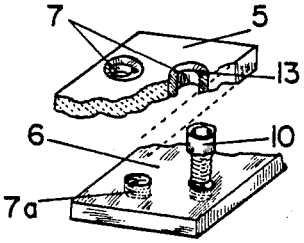
FIG-2
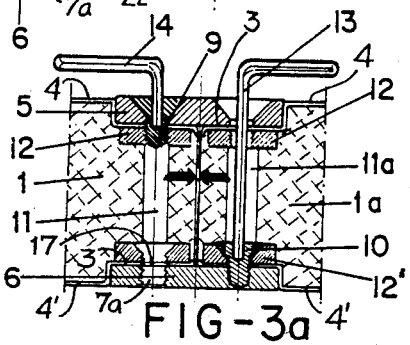
FIG-3a
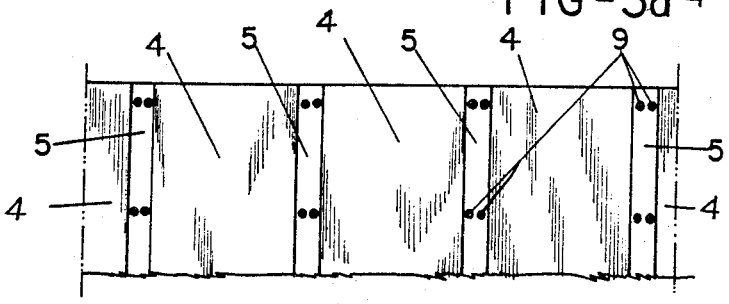
FIG-4
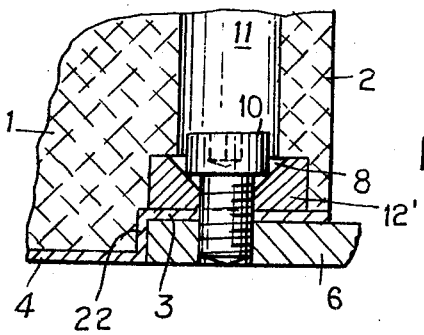
FIG-3b FIG-5
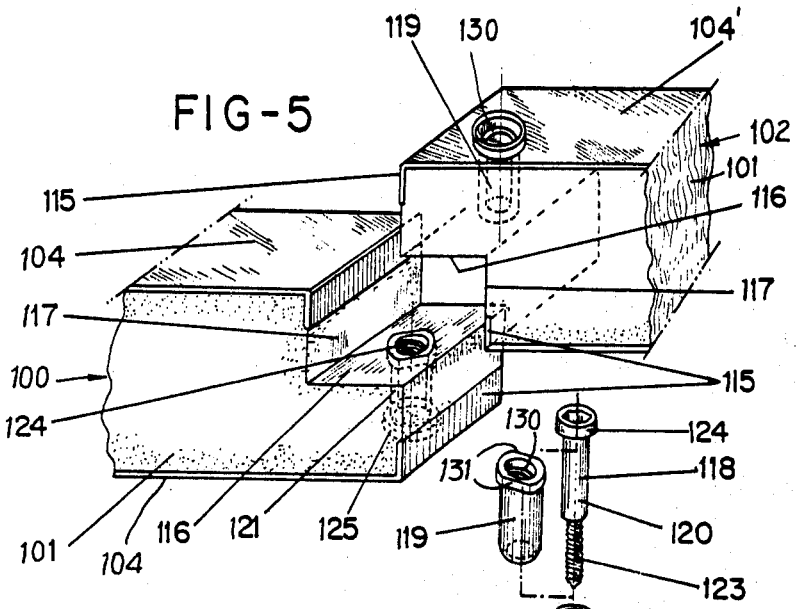
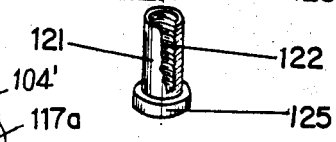
FIG-7
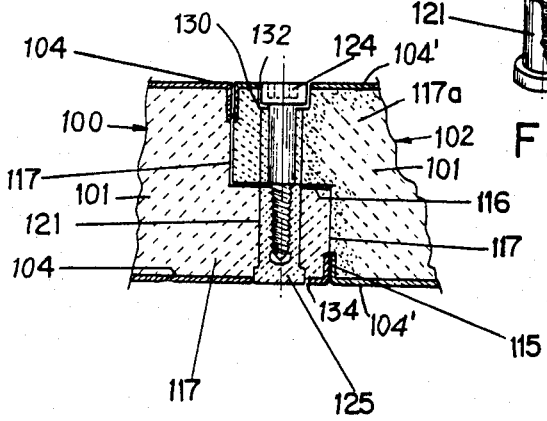
FIG-6

WALL PANEL CLAMPING APPARATUS

BACKGROUND OF THE INVENTION

This invention relates generally to a wall panel clamping apparatus of the type used to join two adjacent wall panels and more particularly, to a clamping apparatus which provides flush wall surfaces, a leak-tight joint, and to a clamping apparatus which is locked in position entirely from one side of the wall. In the joining systems of the prior art, interlocked linear groovings on the panels to be joined has been almost a requisite for a good joint. When connecting the panels, the two wall panels are joined together by a sliding motion of one panel relative to the other. Spacing between the panels is only controlled by the two surfaces of contact between the adjacent panels and the precision of their construction. Bolts pass through the joint from one side and are tightened from the opposite side. The result is generally a joining of wall panels which is not tight, and in the case of insulated wall panels wherein an insulating material is sandwiched between metal skins, there is frequently a gap or cleavage at the joint between the insulating materials of the adjacent panels. Further, the surfaces of the joined panels are frequently marred by protrusion of the heads and fasteners of the bolts.

What is needed is a wall panel clamping apparatus which provides a joint surface which is flush, and provides a tight, leak-free joint between the panels. Also, it is desirable that the panels be joined by a person working from only one side of the wall.

SUMMARY OF THE INVENTION

Generally speaking, in accordance with the invention, a wall panel clamping apparatus especially suited for the construction of refrigeration or thermal chambers, is provided. In the clamping apparatus of this invention, wall panels having thermal insulation sandwiched between opposed metal skins, are joined together to provide a rigid joint which is flush and vacuum tight. Narrow, heavy gauge elongated strip plates fit precisely within offsets in both skins adjacent to the joining surfaces, and are bolted to the skins. One strip plate includes internally threaded holes in which the fastening bolts are inserted and engaged from within the panel using a screwdriver or wrench which passes from the opposite side through a clearance channel in the panel.

The other plate is held on the opposite panel side by bolts which engage threaded nuts attached to the adjacent offset skin portions. All bolt fasteners are accessible and attached from the same wall surface, with the bolts within the panels passing freely through the threaded nuts on the opposite skin. Accurate spacing of the holes in the plates and skin offsets assures a compressed butt joint between the insulation of the clamped panels.

In an alternative embodiment of this invention, the ends of the panels to be joined are provided with offsets which interlock and provide alignment of the adjacent panels before and after they are clamped together with bolts.

Accordingly, it is an object of this invention to provide an improved wall panel clamping apparatus which provides a flush joint for two adjacent wall panels, the surfaces being flush on both sides.

Another object of this invention is to provide an improved wall panel clamping apparatus which allows for easy joining of adjacent panels from only one side of the wall.

A further object of this invention is to provide an improved wall panel clamping apparatus which joins insulated panels together with a compressed contact between the insulation of the adjacent panels.

Still another object of this invention is to provide an improved wall panel clamping apparatus which provides a strong and leak-tight joint between adjacent panels.

Still other objects and advantages of the invention will in part be obvious and in part be apparent from the specification.

The invention accordingly comprises the features of construction, combination of elements, and arrangement of parts which will be exemplified in the construction hereinafter set forth, and the scope of the invention will be indicated in the claim.

BRIEF DESCRIPTION OF THE DRAWINGS

For a fuller understanding of the invention, reference is had to the following description taken in connection with the accompanying drawings, in which:

FIG. 1 is a cross sectional view of two adjacent insulated wall panels partially joined by the clamping apparatus in accordance with this invention;

FIG. 2 is a perspective view of fragments of the clamping apparatus of FIG. 1;

FIG. 3*a* is a view similar to FIG. 1 showing the method of applying the clamping apparatus of this invention;

FIG. 3*b* is an enlarged view of a portion of FIG. 3*a* illustrating the internal bolt fastening;

FIG. 4 is a side elevational view of a plurality of panels joined by the clamping apparatus of this invention;

FIG. 5 is an exploded perspective view of an alternative embodiment of the clamping apparatus of this invention;

FIG. 6 is a side sectional view of the clamping apparatus of FIG. 5 in an assembled condition; and FIG. 7 is an exploded view of the fasteners used in the embodiment of FIG. 5.

DESCRIPTION OF THE PREFERRED EMBODIMENT

Insulated wall panels are frequently joined together in the construction of refrigerating or thermal chambers. The panels or walls are comprised of a compact insulation material, for example, a chemical foam, which is sandwiched between, and frequently adhered to, skins of metal serving as the outer surfaces of the wall panels. As seen in FIG. 1, the panels in accordance with this invention are comprised of insulating material 1, 1*a* sandwiched between skins 4, 4' of metal. The two adjacent panels 16, 18 illustrated in FIG. 1 abut substantially along the interface line 2. The panels 16, 18 are mirror images at the joint, which in the embodiment of FIG. 1 runs perpendicularly between the skins 4, 4'. The thickness 20 of the wall panels 16, 18 is reduced adjacent to the interface line 2 by right angle offsets providing the planar surfaces 3 recessed below the skins 4, 4' and parallel thereto. The recessed surfaces 3 are connected to the adjacent skin 4 by means of short portions 22 which run perpendicular to both the skins 4, 4' and the recessed portions 3. The recessed surfaces 3 extend for the entire length of the joint interface 2 between the two adjacent panels 16, 18, that is, in a vertical wall panel the joint may extend from the floor to the ceiling of the chamber comprised of the wall panels.

For purposes of this description, the lower surfaces or skins 4' are considered to be the outside surfaces of the wall comprised of the panels 16, 18. It should be obvious that this is an arbitrary selection and either skin may be the outside or the inside of the wall. Nuts 12 are fixedly attached to the recessed surfaces 3, within the insulating masses 1, 1*a*, adjacent to the skin 4 and the interface line 2. These nuts 12 have internal threads. Washers 12 are fixedly attached to the lower (FIG. 1) or bottom recessed surfaces 3 associated with the skin 4'. The washers 12' are not threaded and have a downwardly tapering conical opening 8 therethrough. The nuts 12 and washers 12' are fixedly attached to the recessed surfaces 3 by welding or other suitable means. The center lines 15 between the openings 19 in the nuts 12 and washers 12' in the same panel are colinear. The openings 17 in the washers 12' are accessible for insertion of bolts, as described more fully hereinafter, through the channels 11, 11*a* which pass through the insulation materials 1, 1*a*, respectively and are aligned with the openings of the nuts 12 and washers 12'. As seen in FIG. 4, these holes occur in pairs at spaced intervals along the entire length of the joints.

The strip plate 5 is dimensioned to fit in the recess comprised of the surfaces 3, 22, and extends the entire length of the joint. Holes 7 pass through the plate 5 in positions of registry with the openings in the recessed surfaces 3. The holes 7 are countersunk so that flat head bolts 9 may be inserted therethrough and provide a flush surface. As seen in FIG. 3*a*, the bolts 9 engage the threaded holes 19 in the nuts 12 when the joint is clamped. The bolts 9 are illustrated as Allen head bolts and they are fastened with an Allen wrench 14 inserted in the head socket, all in the well known manner. It should be readily understood that slotted head, Phillips head, etc., bolts 9 could be used with equal effectiveness. The thickness 26 of the strip plate 5 equals the depth of the recess 3 in the skin 4, such that after assembly the surface of the joint is flush.

The strip plate 6 fits in the lower (FIG. 1) recessed surface 3 between the perpendicular portions 22 associated with the skin 4'. Holes 7*a* in the strip plate 6 are provided at spaced intervals so as to be in registry with the holes 17 in washers 12'. The holes 7*a* in the strip plate 6 are internally threaded and receive bolts 10 which are round-headed and of the Allen head type. The head of the bolt 10 is able to pass through the threaded openings 19 in the nuts 12 without engagement therewith. Thus, as seen in FIG. 3*a*, a long Allen wrench 13 with the bolt 10 temporarily attached by insertion of the wrench 13 into the socket of the bolt head 10, is inserted through the washer opening 17, and screwed into the threaded hole 7*a* in the strip plate 6. The aligned channels 11, 11*a* makes possible the fastening of bolts 10 from the inside surfaces 4 of the panels 16, 18 when the bolts 9 have not yet been secured to the nuts 12. The strip plate 6 rests on the recessed surface 3 and fits snugly between the vertical portions 22 in a manner similar to the seating of the inside strip plate 5 described above. A flush surface is provided at the lower (FIG. 1) or outside surface 4'. The spacing between the center lines 15 of the channels 11, 11*a* through the insulation 1, 1*a*, and the spacing between the paired holes 7, 7*a* in the strip plates 5, 6 are substantially identical. The spacing is selected so that when the panels 16, 18 are joined together by means of the bolts 9, 10 seated in their associated threaded receptacles 7*a*, 19, the insulating masses 1, 1*a* are in compression contact along the interface line 2. As best seen in FIGS. 3*a*, 3*b*, the insulating materials 1, 1*a* extend substantially for the entire thickness of the joint between the recessed surfaces 3 at opposite ends of the joint. The compressive forces are indicated by the heavy arrows in FIG. 3*a*.

Two adjacent panels 16, 18 are clamped together by the apparatus of this invention in the following sequence. The panels 16, 18 are brought into adjacent abuttment along the interface line 2. The strip plate 6 is inserted into the recessed portion at the joint resting on the recessed surfaces 3 associated with the skin 4'. A bolt 10 attached to the end of the Allen wrench 13 is inserted through the nut 12, through the connecting channel 11, and through the opening 17 in the washer 12'. The bolt 10 is then screwed into the opening 7*a* of the plate 6 and turned until the plate 6 is tightly against the recessed surface 3 to make a rigid joint. The conical opening 8 in the washer 12' aids in guiding the bolt 10 to the threaded hole 7*a*. After the bolt 10 is secured, the Allen wrench 13 is withdrawn through the opposite skin 4 and the strip plate 5 is positioned in the recess associated with the skin 4, resting on the surfaces 3. The bolts 9 are threaded into place engaging the nuts 12. The bolts 9 are turned until the plate 5 is firmly against the recessed portion 3 whereby a rigid joint is provided.

The sequence of operation is repeated for each pair of holes until all of the holes in a linear joint have been engaged with bolts. It should be noted all of the bolts 9, 10 are fastened from the same side 4 of the wall panels. This makes for simple assembly and disassembly of the wall joints, and, as described above, assures a tight clamping between the internal insulation materials 1, 1*a* which assures a leak-tight joint. The strip plates 5, 6 in engagement with the washers 12' and nuts 12, provide a strong rigid connection.

An alternative embodiment of this invention is shown in FIG. 5. The panels 100, 102 are comprised of an insulating material 101 sandwiched between metal skins 104, 104'. The panel ends for joining the panels together include an L-shaped cross section formed by an extension in length of one skin beyond the opposed skin on the same panel. The L-shaped or offset cross-sections include the horizontal (FIG. 5) surfaces 116 which are parallel to the skins 104, 104' and the surfaces 117 which are perpendicular to the skins. The offset profiles extend along the entire length of the joint. The skins 104, 104' bend inwardly toward each other at the offset ends providing perpendicular flanges 115 which protect the edges of the insulation 101 from breakage and chipping, and also provide good abutting alignment between the panels 100, 102 at the joint. As seen in FIGS. 5 and 6 the flanges 115 are flush with the insulation material 101 of the perpendicular surfaces 117.

An extended length weld washer 119 is fixed to the upper skin 104' of the panel 102 by welding, and has smooth inner walls for the passage therethrough of the through bolt 118. A shoulder 130 (FIG. 5) in the weld washer 119 restrains the head 124 of the bolt 118. Flat bevel surfaces 131 on the weld washer 119 provide a secure fastening for the weld washer 119 in the opening 132 provided in the upper skin 104'. The opening 132 is contoured to align to the flat surfaces 131 in the washer 119 and prevent rotation of the washer 119. The weld washer 119 is flush with the skin surface 104' at one end and with the horizontal surface 116 of the insulation 101 at the other end.

The weld nut 121, having internal threads 122, is attached to the lower skin 104 of the panel 100 by means of the base 125 which is inserted in a matching opening 134 of the skin 104 and welded thereto. Flat bevel surfaces (not shown) prevent rotation of the weld nut 121 in the hole 134. The weld washer 119 and weld nut 121 are secured to the skins 104', 104 (respectively) prior to molding of the insulation material between the skin. Welding may be omitted in an alternative embodiment when the insulation is firm and there is a good fit of the bevel nut and washer into the skin openings. The weld nut 121 is flush with the skin surface 104 and the insulation surface 116 of the panel 100.

The through bolt 118 includes an unthreaded portion 120 which corresponds in length to the length of the weld washer 119 such that the threaded portion 123 of the through bolt 118 extends into and engages the internal threads 122 of the weld nut 121.

In clamping the panels the 100, 102 together, the ends of the panels are placed with the offset portions overlapping and with the vertical insulation surfaces 117 and the horizontal surfaces 116 in abuttment. The flanges 115 on the opposed panels are also in abuttment. The L-shaped contours are formed with precision and the weld nut 121 and the weld washer 119 are positioned with precision, such that when the through bolt 118 is tightened, there is compressive contact between the vertical insulation surfaces 117 and the horizontal insulation surfaces 116 whereby a leak-tight joint is provided. The shoulder 130 in the weld washer 119 limits the depth of penetration of the bolt 118. The abuttment of the metal flanges 115 assures good mechanical strength in the joint. The panels are clamped together at spaced intervals along the entire length of the joint. The head 124 of the bolt 118 is recessed in the weld washer 119 and both surfaces 104, 104' at the joint are flush when the offset ends are overlapped as described above.

The panels are clamped together without any need to slide one panel relative to the other and the entire fastening operation is accomplished from one side of the wall panels.

It will thus be seen that the objects set forth above, among those made apparent from the preceding description, are efficiently attained and, since certain changes may be made in the above construction without departing from the spirit and scope of the invention, it is intended that all mater contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A wall panel clamping apparatus comprising:

a first wall panel, said first panel having a first surface and an opposed parallel second surface, said first surface extending beyond said second surface at the end of said panel, said end being comprised of planar portions arranged to form an L-shaped profile, said L-shaped profile including two portions perpendicular to said first and second surfaces and one portion parallel to said first and second surface;

a transverse unthreaded hole in said first surface of said first panel, said hole extending between said first surface and said parallel portion of said first panel;

a second wall panel, said second panel having a first surface and an opposed parallel second surface, said second surface extending beyond said first surface at the end of said panel, said end being comprised of planar portions arranged to form an L-shaped profile, said L-shaped profile including two portions perpendicular to said first and second surfaces and one portion parallel to said first and second surfaces;

a transverse threaded hole in said first surface of said second panel, said threaded hole extending between said second surface and said parallel portion of said second panel, said horizontal portions of said panels being overlapped and abutting, and said perpendicular portions abutting;

insulating material interposed between the first and second surfaces of each of said panels, said planar portions of said L-shaped profiles including surfaces of said insulating material;

a through bolt extended through said unthreaded hole and engaging said threaded hole, the head of said bolt being constrained from passing through said unthreaded hole, whereby said panels are rigidly clamped together.

2. The wall panel clamping apparatus of claim 1 wherein said unthreaded hole in said first panel comprises a washer attached to said first surface of said first panel.

3. The wall panel clamping apparatus of claim 2 wherein said threaded hole in said second panel comprises a threaded nut attached to said second surface of said second panel.

4. The wall panel clamping apparatus of claim 3 and further comprising inwardly turned flanges on said first and second surfaces, said flanges being parallel to said perpendicular portions and flush therewith and extending part way to said portion parallel to said first and second surfaces.

5. The wall panel clamping apparatus of claim 1 wherein said first surfaces of said panels are flush one to the other and said second surfaces of said panels are flush one to the other.

6. The wall panel clamping apparatus of claim 5 wherein said through bolt is recessed below said first surface of said first panel.

7. The wall panel clamping apparatus of claim 4 wherein said holes are positioned in said panels to create compression in said insulation along the abutting interfaces.

8. The wall panel clamping apparatus of claim 1 wherein said first and second surfaces are comprised of skins fabricated of metal.

9. The wall panel clamping apparatus of claim 4 wherein said first surfaces of said panels are flush one to the other and said second surfaces of said panels are flush one to the other.

* * * * *